US006978797B2

(12) United States Patent
Nagler et al.

(10) Patent No.: US 6,978,797 B2
(45) Date of Patent: Dec. 27, 2005

(54) STACKABLE HOSE REEL WITH FOLDING FLANGES

(75) Inventors: Ehud Nagler, Kiryat Tivon (IL); Zvi Yemini, Yafo (IL)

(73) Assignee: Hydro-Industries Tynat Ltd., Rosh Ha'ayin (IL)

( * ) Notice: Subject to any disclaimer, the term of this patent is extended or adjusted under 35 U.S.C. 154(b) by 15 days.

(21) Appl. No.: 10/840,298

(22) Filed: May 7, 2004

(65) Prior Publication Data

US 2005/0247345 A1 Nov. 10, 2005

(51) Int. Cl.[7] ..... B65H 75/34
(52) U.S. Cl. ..... 137/355.27; 137/355.16; 137/355.26; 242/395; 242/401
(58) Field of Search ..... 137/355.26, 355.27, 137/355.16; 242/395, 401

(56) References Cited

U.S. PATENT DOCUMENTS

| | | | | |
|---|---|---|---|---|
| RE32,510 | E * | 9/1987 | Tisbo et al. | 137/355.27 |
| 5,425,391 | A * | 6/1995 | Tisbo et al. | 137/15.01 |
| 5,568,824 | A * | 10/1996 | Cordrey | 137/355.27 |
| 5,657,789 | A | 8/1997 | Tisbo et al. | |
| 5,704,384 | A | 1/1998 | Tisbo et al. | |
| 5,794,649 | A * | 8/1998 | Spear et al. | 137/355.27 |
| 5,901,730 | A | 5/1999 | Tisbo et al. | |

* cited by examiner

*Primary Examiner*—A. Michael Chambers
(74) *Attorney, Agent, or Firm*—Mark M. Friedman

(57) ABSTRACT

A hose-reel assembly includes a reel with foldable flange portions to allow compact shipping and storage in a pre-assembled state. The reel is rotatably mounted on a support frame which either stacks with similar frames or has selectively deployable legs to allow packaging of the assembly in a rectangular box of height less than the reel diameter.

19 Claims, 13 Drawing Sheets

STACKABLE HOSE REEL WITH FOLDING FLANGES

FIELD AND BACKGROUND OF THE INVENTION

The present invention relates to hose-reel assemblies and, in particular, it concerns hose-reel assemblies which include a reel with foldable flange portions to allow compact shipping and storage.

It is known to provide various hose-reel assemblies for storing a length of hose such as a domestic garden hose. Hose-reel assemblies exist in many forms including, but not limited to, free-standing hose-reel assemblies, wall-mounted hose-reel assemblies, hose caddies or carts with wheels, and motorized hose-reel assemblies of any of the aforementioned types where a motor powers rotation of the reel to rewind the hose after use.

In most cases, hose-reel assemblies are relatively bulky and cannot be efficiently stacked when assembled. The option of shipping products in a more compact unassembled state, on the other hand, is unpopular with consumers due to the perceived complexity of the assembly process. For this reason, hose-reel assemblies are primarily shipped and sold in their assembled state, resulting in problematic wastage of expensive transportation space and even more expensive retail store space.

In an attempt to address this problem, U.S. Pat. Nos. 5,425,391; 5,657,789; 5,704,384; and 5,901,730 to Suncast Inc. propose stackable hose-reel assemblies in which the reel has a narrow partial flange of roughly rectangular shape. The reduced dimension of the flange allows stacking of the hose-reel assemblies, thereby facilitating efficient shipping and storage of the hose-reel assemblies in their assembled state.

Although the Suncast designs allow pre-assembled shipping, thereby avoiding the problem of end-user assembly, the narrow rectangular flange configuration generates new problems as illustrated schematically in FIGS. 1A and 1B. Specifically, it will be noted that a rounded flange as conventionally used in almost all hose-reel assemblies tends to guide the hose to remain within the region of the reel as shown in FIG. 1A. In contrast, the almost-radial edges of the rectangular flange of the Suncast design tend to catch on the hose during rewinding if the hose is not aligned perpendicular to the reel axis. This will tend to "derail" the hose from the reel as shown in FIG. 1B, thereby interfering with the rewinding process.

An additional shortcoming of the rectangular flange shape is a large proportion of the wound hose is not fully supported, tending to allow the hose to sag outwards and possible interfere with winding. The rectangular flange structure is also particularly problematic for implementing a motor-driven hose-reel where the cross-over between edges of the rectangular flange and edges of the frame (not shown) creates a scissor-like action, posing a significant safety risk to the user.

There is therefore a need for a stackable hose-reel assembly which would allow efficient stacking of pre-assembled units while maintaining a generally rounded flange configuration.

SUMMARY OF THE INVENTION

The present invention is a hose-reel assembly which includes a reel with foldable flange portions to allow compact shipping and storage.

According to the teachings of the present invention there is provided, a stackable hose-reel assembly comprising: (a) a support frame; and (b) a reel rotatably attached to the frame so as to be rotatable about an axis of rotation, the reel including: (i) a drum circumscribing the axis of rotation for receiving a length of hose coiled thereabout; and (ii) a pair of flanges, one of the flanges being attached to, or integrally formed with, each of a first side and a second side of the drum, each of the flanges having a fixed portion rigidly associated with the drum and at least one foldable portion hinged to the fixed portion so as to be displaceable between a folded state and a deployed state, such that, when the foldable portions assume the folded state, the hose-reel assembly is stackable with other similar hose-reel assemblies at a stacking step height H, and when the foldable portions assume the deployed state, the fixed portion and the corresponding at least one foldable portion together form a flange with a minimum dimension D measured perpendicular to the axis, where D is greater than H.

According to a further feature of the present invention, D is greater than H by at least 50%.

According to a further feature of the present invention, each of the flanges has two of the foldable portions hinged to the fixed portion along substantially parallel hinges on opposite sides of the axis.

According to a further feature of the present invention, each of the flanges has a substantially elliptical outer shape when the foldable portions are in the deployed state.

According to a further feature of the present invention, each of the flanges has a substantially circular outer shape when the foldable portions are in the deployed state.

According to a further feature of the present invention, each of the flanges further includes at least two retractable extension portions radially displaceable between a recessed position in which the extension portions are retracted within the flanges and an extended position in which the extension portions provide a locally increased maximum dimension of the flange as measured perpendicular to the axis.

According to a further feature of the present invention, the fixed portions and the foldable portions are configured such that, when the foldable portions are moved from the folded state to the deployed state, the foldable portions are locked, at least temporarily, in the deployed state.

According to a further feature of the present invention, there is also provided a telescopic handle associated with the support frame and configured to assume a collapsed state for stacking of the hose-reel assembly and an extended state for holding the stackable hose-reel assembly during use.

According to a further feature of the present invention, the flanges and the telescopic handle are configured such that, when the telescopic handle assumes the collapsed state and the foldable portions assume the folded state, the telescopic handle and the reel engage so as to substantially lock the reel against rotation relative to the support frame.

According to a further feature of the present invention, the support frame includes at least two selectively deployable legs configured to assume a non-deployed state for stacking of the hose-reel assembly and a deployed state for supporting the stackable hose-reel assembly during use.

According to a further feature of the present invention, the selectively deployable legs are separate from a remainder of the support frame when in the non-deployed state and are attachable to the remainder of the support from to provide the deployed state.

According to a further feature of the present invention, the selectively deployable legs are implemented as foldable legs pivotable between the non-deployed state and the deployed state.

According to a further feature of the present invention, the selectively deployable legs are implemented as telescopic legs slidable between the non-deployed state and the deployed state.

According to a further feature of the present invention, the support frame is configured such that, when the selectively deployable legs are in the non-deployed state, one dimension of the stackable hose-reel assembly measured perpendicular to the axis is no greater than stacking step height H.

According to a further feature of the present invention, the flanges and the selectively deployable legs are configured such that, when the selectively deployable legs assume the non-deployed state and the foldable portions assume the folded state, the reel and a surface associated with at least one of the selectively deployable legs engage so as to substantially lock the reel against rotation relative to the support frame.

According to a further feature of the present invention, the support frame has a minimum dimension measured perpendicular to the axis greater than stacking step height H, the support frame being stackable with other similar support frames at stacking step height H.

According to a further feature of the present invention, there is also provided a motor associated with the support frame and the reel for rotating the reel relative to the support frame.

According to a further feature of the present invention, the motor is deployed primarily within the drum.

According to a further feature of the present invention, there is also provided at least one wheel associated with the support frame for supporting the stackable hose-reel assembly so as to be rollable on an underlying surface.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
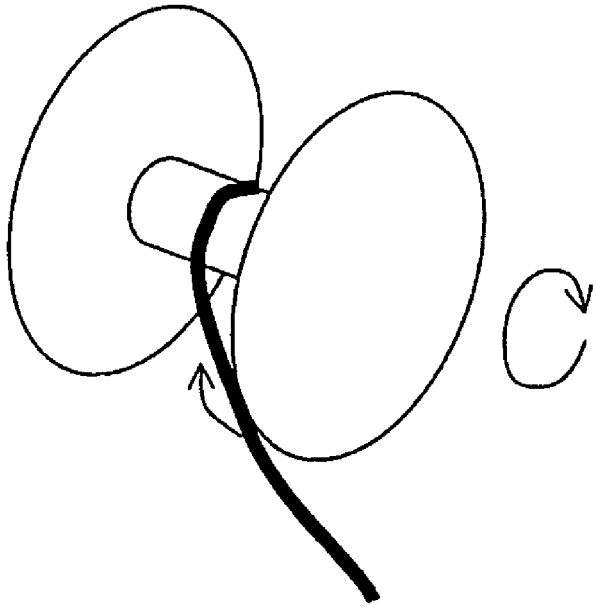
FIG 1A (PRIOR ART)
FIG. 1A is a schematic representation of the operation of a hose reel with circular flanges.
Figure 1B:
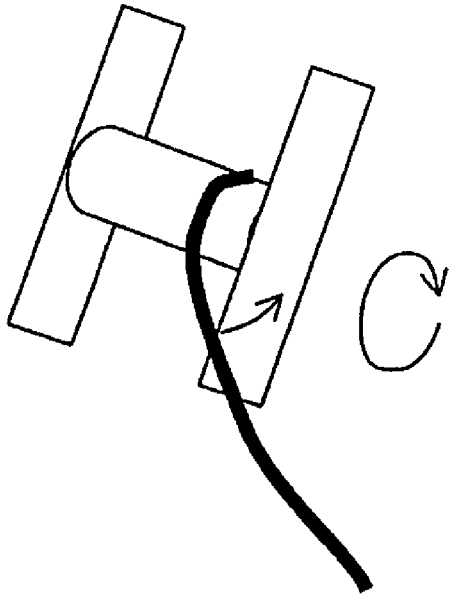
FIG. 1B (PRIOR ART)
FIG. 1B is a schematic representation of a problem occurring during the operation of a hose reel with rectangular flanges.

The present invention is a hose-reel assembly which includes a reel with foldable flange portions to allow compact shipping and storage.

The principles and operation of hose-reel assemblies according to the present invention may be better understood with reference to the drawings and the accompanying description.

Referring now to the drawings, FIGS. 2A–8, 11A–11C and 12A–12C show three embodiments of a stackable hose-reel assembly, constructed and operative according to the teachings of the present invention. Generally speaking, in each case, the hose-reel assembly has a reel 10 rotatably mounted on a support frame 12 so as to rotatable about an axis of rotation 14. Reel 10 includes a drum 16, circumscribing axis of rotation 14, for receiving a length of hose (not shown) coiled thereabout, and a pair of flanges, attached to, or integrally formed with, opposite sides of drum 16. Each of the flanges has a fixed portion 18 rigidly associated with drum 16, and at least one foldable portion 20 hinged to fixed portion 18 so as to be displaceable between a folded state (e.g., FIGS. 2A and 5A–5D) and a deployed state (e.g., FIGS. 2B and 6). The reel and support frame are thus configured such that, when foldable portions 20 assume the folded state, the hose-reel assembly is stackable with other similar hose-reel assemblies at a stacking step height H (e.g., FIG. 7), and when foldable portions 20 assume the deployed state, the fixed portion and the corresponding at least one foldable portion together form a flange with a minimum dimension D measured perpendicular to the axis (e.g., FIG. 4), where D is greater than H.

At this point, it will readily be appreciated that the present invention offers profound advantages over the various prior art discussed above. Firstly, by allowing compact stacking (i.e., at a stacking step less than the diameter of the reel flanges) of the hose-reel assemblies in their assembled state, the problems of end-user assembly are avoided. At the same time, by providing folding flange portions, the final flange shape may approximate to the normal rounded flange shape with the corresponding aesthetic advantages as well as the functional advantages discussed above with reference to FIG. 1A. These and other advantages of the present invention will become clearer from the following detailed description.

Before addressing the features of preferred embodiments of the present invention in more detail, it will be useful to define certain terminology as used herein in the description and claims. The term "hose-reel assembly" is used to refer generically to any assembly including a rotatable reel upon which a length of hose may be wound, but does not include the hose itself. Primarily, the present invention relates to hose-reel assemblies of the type in which one end of a hose is attachable to a water supply connection on or within the reel such that the hose is continuously connected to a water supply and can be used to deliver water in both an unwound and a partially wound state.

The term "reel" is used herein to refer to any rotatable element such as a reel or spool upon which the hose is to be wound. The surface or surfaces around which the hose is to be wound are referred to as a "drum". It should be noted that the term "drum" is used here to refer to any element or combination of elements which perform the function of receiving a hose wound around them. Thus, the "drum" need not be cylindrical, as will be clear from the following examples. Furthermore, as is known in the art, the "drum" may be formed from a set of parallel rods or various other structures which together function as a drum to allow winding of the hose thereupon.

With regard to the flanges at each side of the drum, reference is made to a "minimum dimension measured perpendicular to the axis". Geometrically, this may be defined as the smallest separation between two planes, parallel to each other and to the axis of the reel, wherein the entirety of the flange would lie between the planes. In the case of a circular flange, this is simply the diameter of the flange. In the case of an ellipse, this is the small axis of the ellipse.

The hose-reel assemblies of the present invention are described herein as "stackable". The terms "stackable", "stacking", "stacked" etc. are used herein to refer to two or more articles (typically at least three) which are positioned sequentially one upon the other. The terms include both the case where the structures directly engage so as to be partially nested one within the next and the case of non-nesting articles where each article rests on top of the underlying article without direct mechanical engagement. In the latter case, the articles may be separately boxed or wrapped without interfering with the stacking.

Finally with regard to terminology, reference is made to a "stacking step height". This is defined as the magnitude of the "repeat vector" of the stacking pattern, i.e., the distance through which one element would need to be moved to make that element coincident with the position of the next stacked element. It will be noted that this distance is not necessarily defined in a precisely vertical direction, and may vary as a function of the stacking or nesting geometry. It will be understood by one ordinarily skilled in the art that this parameter is well defined by the structure of even a single "stackable" item by the position and geometry of the abutment surfaces which would abut other similar items stacked above and below the item itself.

Turning now to the embodiment of FIGS. 2A–8 in more detail, both reel 10 and support frame 12 are preferably formed entirely or primarily from molded plastic materials. In the case of the reel, drum 16 and fixed flange portions 18 may advantageously be integrally formed in one piece or in halves as is known in the art. Folding flange portions 20 may also be integrally formed attached to fixed portions 18 at integral hinges. Alternatively, snap-together pin-and-socket hinges or any other suitable hinge arrangement may be used to attach separately formed foldable flange portions 20 to the fixed portions 18. In either case, the attachment is preferably permanent in the sense that the parts are not readily disassembled by a user.

Each flange preferably has two foldable portions 20 hinged to fixed portion 18 along substantially parallel hinges on opposite sides of axis 14. This allows the reel to assume a folded configuration with generally parallel upper and lower surfaces, formed by the folded portions 20, which is particularly convenient and efficient for stacking.

The configuration with pairs of foldable portions 20 as shown also facilitates significant reduction in the stacking step height H relative to the open flange dimension D. Specifically, in the structure illustrated here, the stacking step height H is substantially equal to the height B of fixed flange portion 18. By using two foldable portions 20 on each flange, the ratio of D to H may readily exceed 3:2 (i.e., D greater than H by at least 50%), and can advantageously be about 2:1 or greater (i.e., D at least about twice H).

Preferably, although not necessarily, fixed portions 18 and foldable portions 20 are configured such that foldable portions 20 lock, either permanently or temporarily, when moved to their deployed state. In the preferred case of a molded plastic construction, this locking effect may be achieved by use of a snap-locking configuration (for example a projecting tooth on foldable portion 20 engaging a corresponding recess on fixed portion 18—not shown), as is known in the art. In certain cases, the presence of a length of hose wound on the reel is sufficient to maintain the deployed state of the foldable portions 20 during use even in the absence of a locking configuration.

As mentioned above, the folding flange structures of the present invention have a particular advantage in that they avoid the narrow rectangular flanges of the aforementioned prior art, instead preferably maintaining a generally rounded shape. It should be appreciated, however, that the deployed flanges of the present invention may vary considerably from a circular shape without departing from the broad scope of the invention as defined in the appended claims.

Figure 2A:
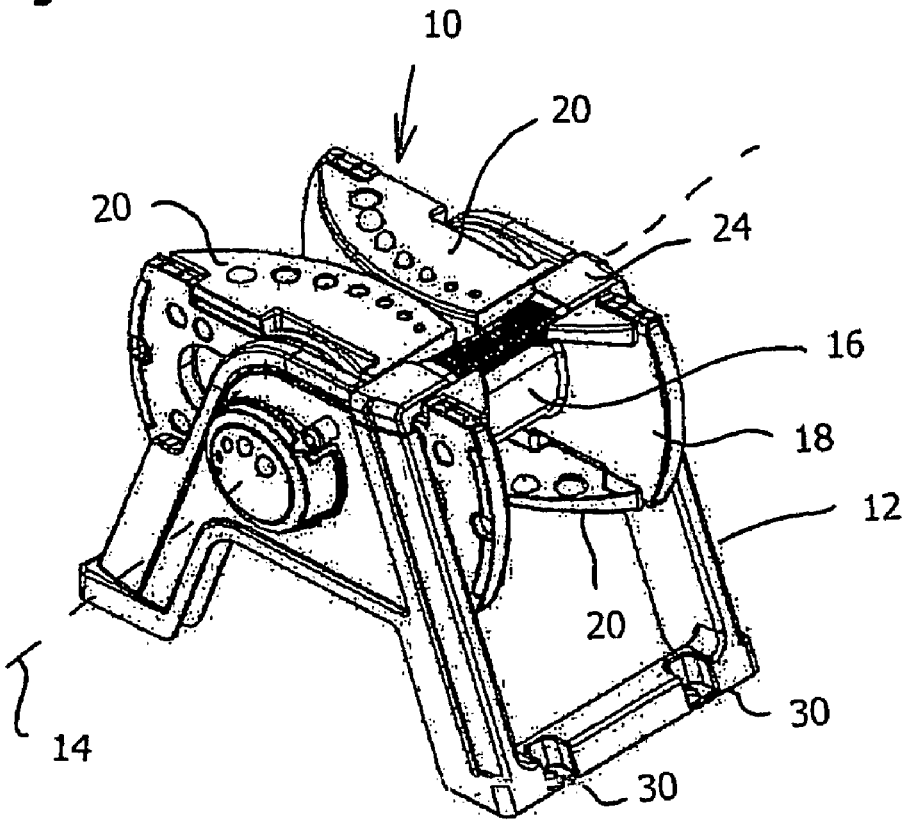
FIGS. 2A–2C are isometric views of a first preferred embodiment of a hose-reel assembly, constructed and operative according to the teachings of the present invention, with foldable flanges shown in a folded state, a deployed state and an extended state, respectively.
Figure 2B:
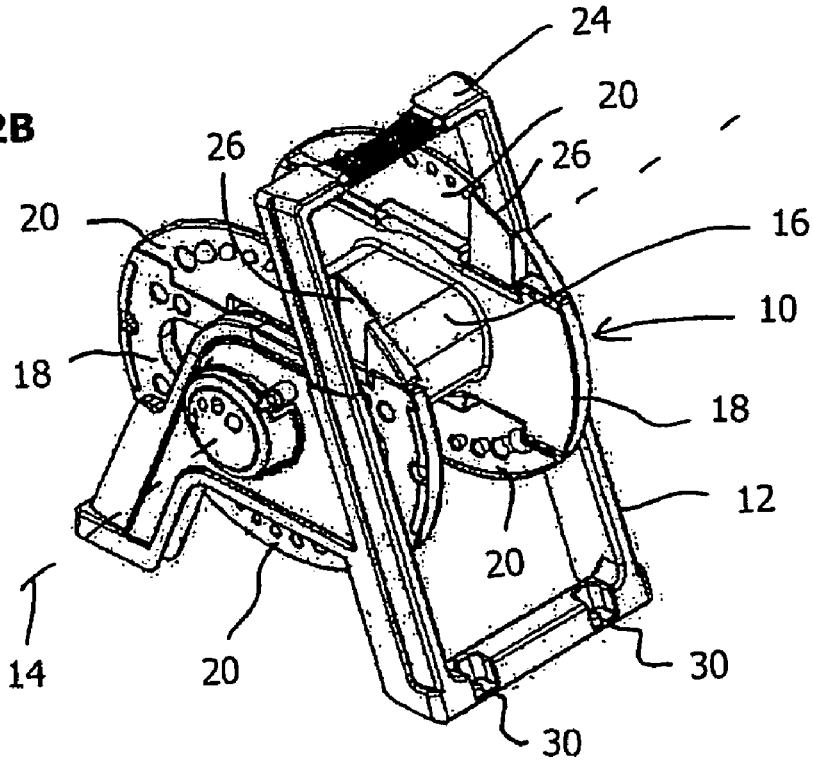
Figure 2C:
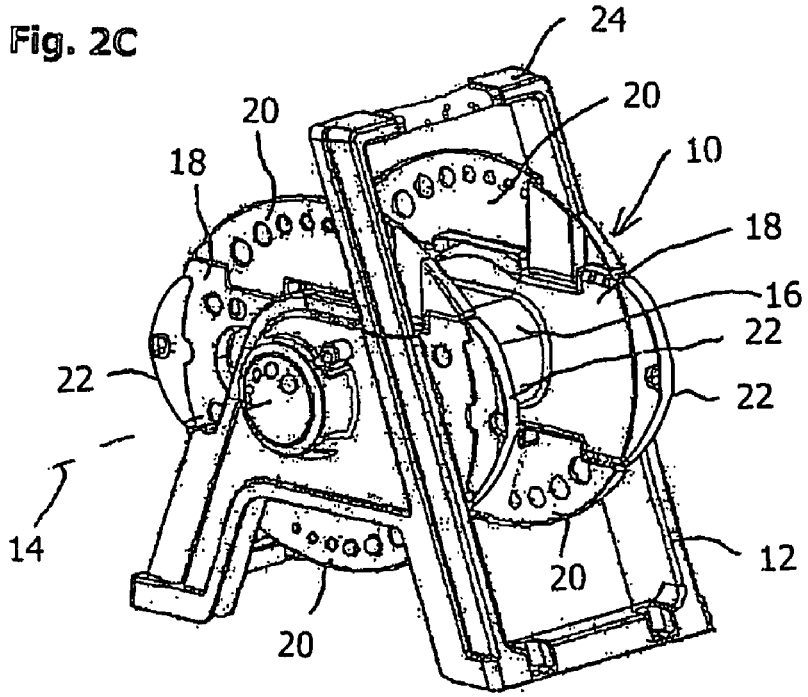
Figure 3:
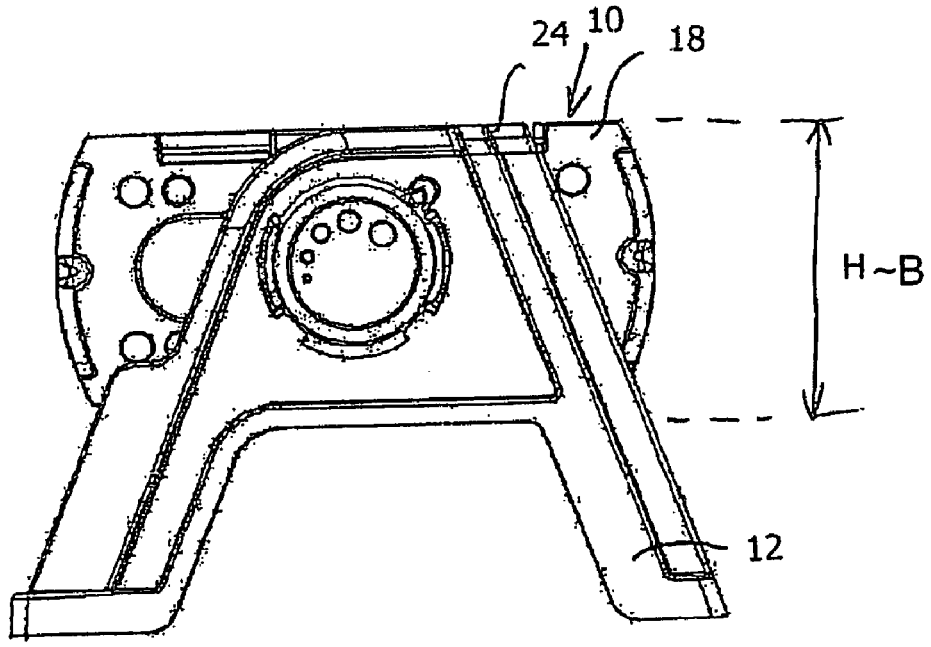
FIG. 3 is a side view corresponding to FIG. 2A.
Figure 4:
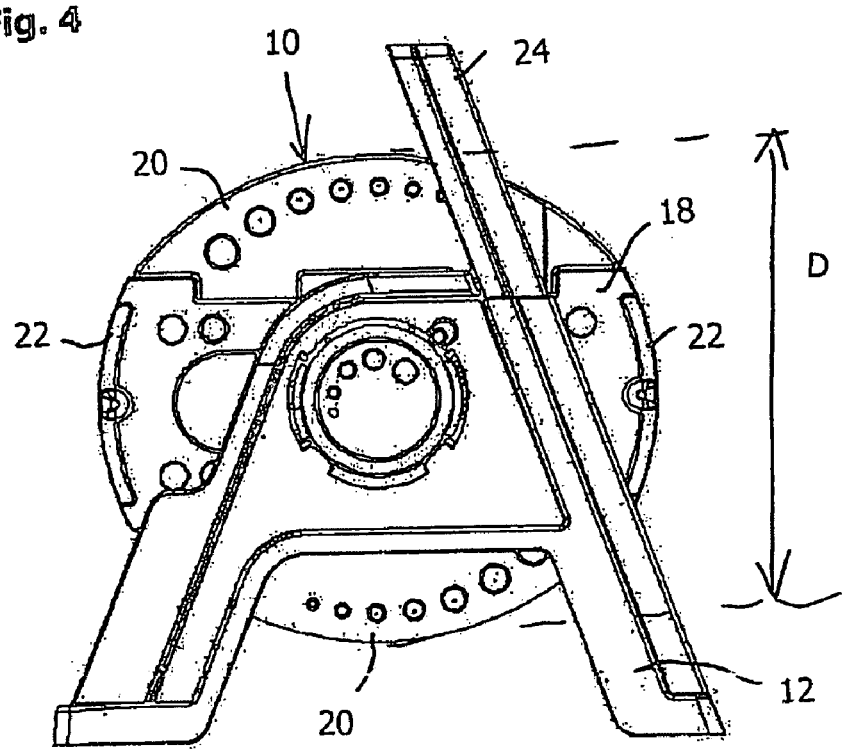
FIG. 4 is a side view corresponding to FIG. 2B.

In the preferred example of FIGS. 2A–8, each of the flanges has a substantially elliptical outer shape, best seen in FIG. 4, when foldable portions 20 are in the deployed state. For a relatively narrow reel, this option allows foldable portions 20 to assume non-overlapping folded positions as best seen in FIGS. 5A, 5C and 5D. In order to allow the hinges of foldable portions to be as close as possible to each other, drum 16 is here preferably formed with flattened surfaces parallel to the hinges. In the case of the elliptical flange, this shape also serves to ensure a relatively uniform winding depth around drum 16 supported by the flange.

Figure 9:
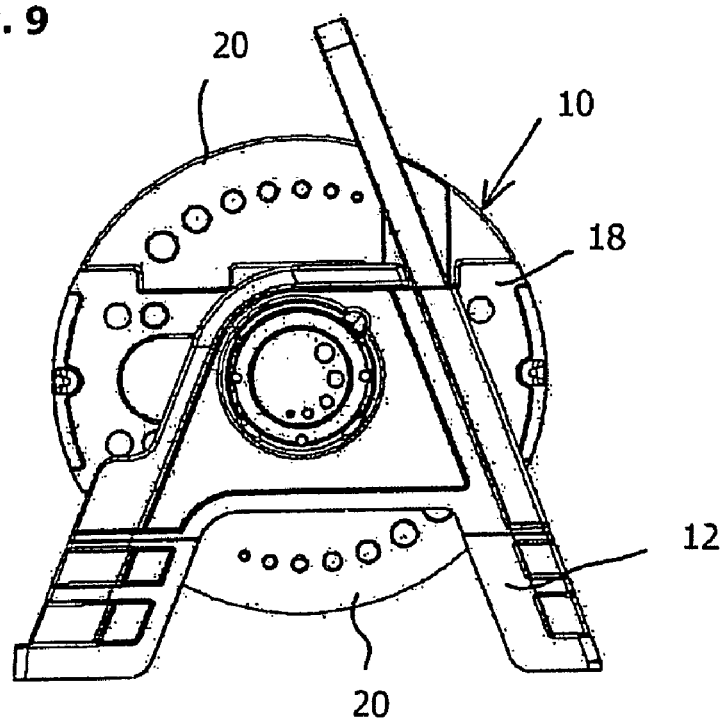
FIG. 9 is a side view of first variant of the hose-reel assembly of FIGS. 2A–8 in which the flanges have a circular shape in the deployed state.

It will be clear that, where the drum is sufficiently wide, or where overlap of foldable portions 20 is acceptable, circular and other flange configurations may be used. By way of examples, FIG. 9 shows a variant implementation in which a substantially circular outer flange shape is provided. Implementations having foldable portions 20 overlapping each other in their folded state will be discussed below with reference to FIGS. 11A–11C and 12A–12C.

A further optional feature visible particularly in FIG. 2C further modifies the outer shape of the deployed flanges by providing in each flange at least two retractable extension portions 22 for providing a locally increased maximum dimension of the flange as measured perpendicular to the axis. Each retractable extension portion 22 is displaceable, typically radially relative to axis 14, between a recessed position in which extension portions 22 are retracted within the flanges (FIG. 2B) and an extended position in which the extension portions project as shown in FIG. 2C. Although somewhat disrupting the rounded outer shape of the flanges, this feature provides an additional option to a user who may wish to store an extended hose of length greater than the hose-reel assembly could otherwise accommodate. The extension portions are preferably rounded to minimize any resultant step in the outer shape of the flange. Optional additional "rounding" may be provided by addition of pop-up side wings (not shown) to both sides of the extension portions 22.

Figure 7:
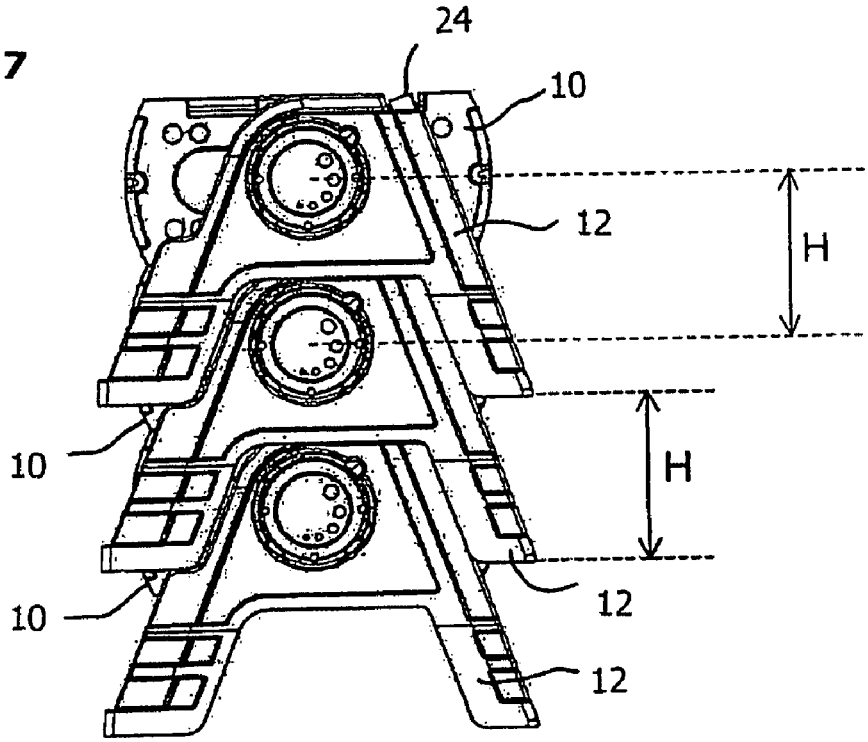
FIG. 7 is a side view similar to FIG. 3 showing three similar hose-reel assemblies stacked together.

Turning now to the features of the support frame in more detail, support frame 12 in this embodiment has a height greater than stacking step height H, the required stacking step height being achieved by partial nesting of the frames as seen in FIG. 7. In order to maximize stacking efficiency, the stacking step height H of support frames 12 is preferably designed to be roughly equal to the minimum dimension of the flanges as measured perpendicular to axis 14 in the folded state.

The preferred embodiment illustrated here further includes a telescopic handle 24 associated with support frame 12. Telescopic handle 24 assumes a collapsed state (FIGS. 2A, 3 and 7) for stacking of the hose-reel assembly and an extended state (FIGS. 2B and 4) in which the handle can be used to hold the stackable hose-reel assembly during use.

Figure 5A:
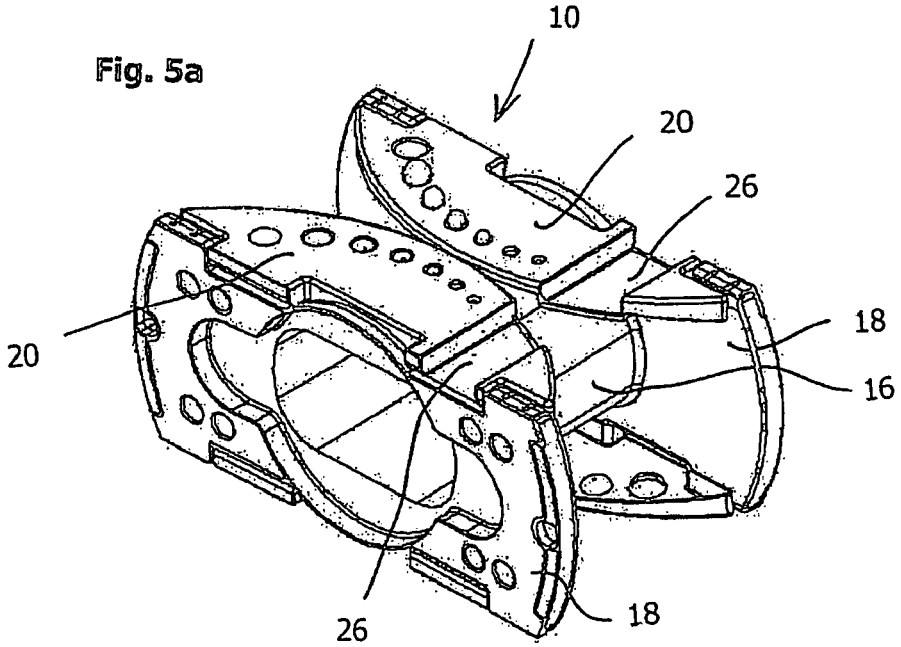
FIGS. 5A–5D are isometric, side, front and plan views, respectively, of a reel from the hose-reel assembly of FIG. 2A shown with its flanges in the folded state.
Figure 5B:
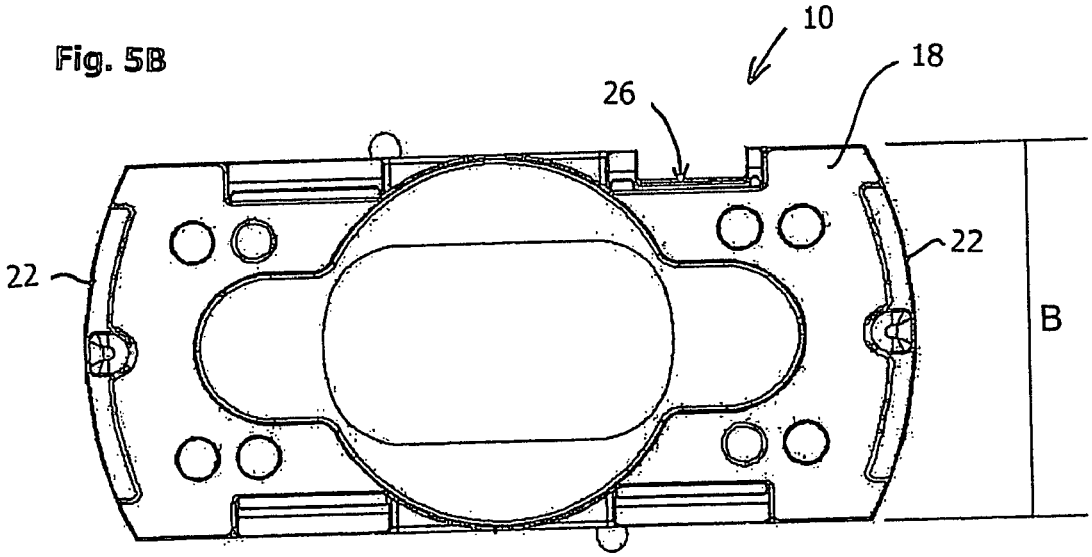
Figure 5C:
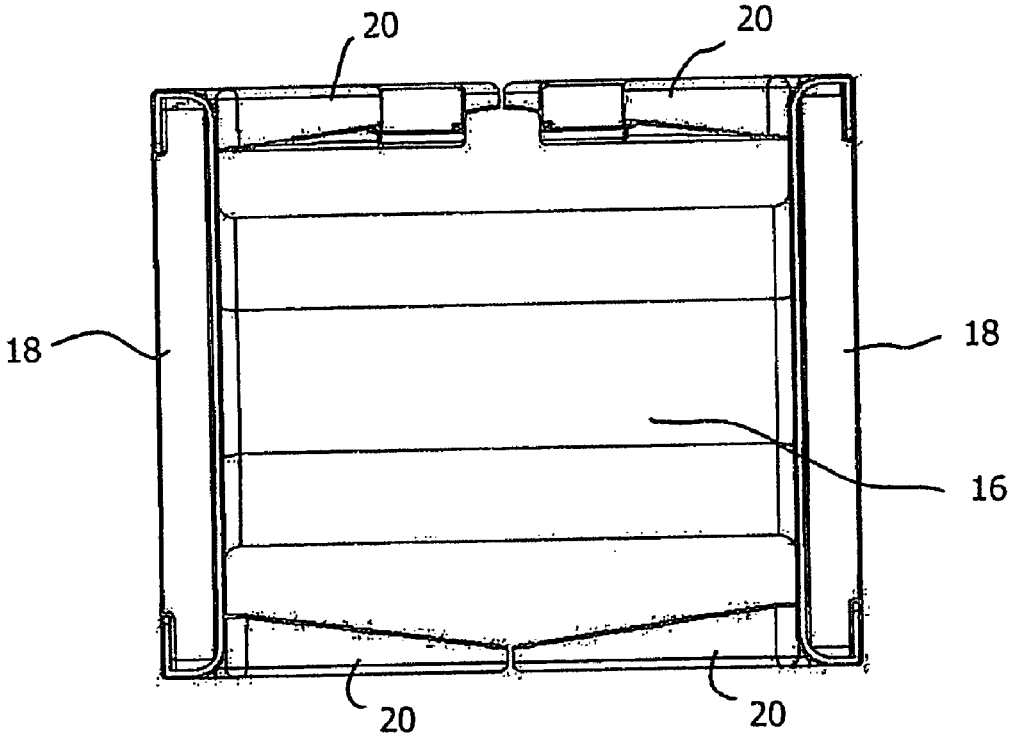
Figure 5D:
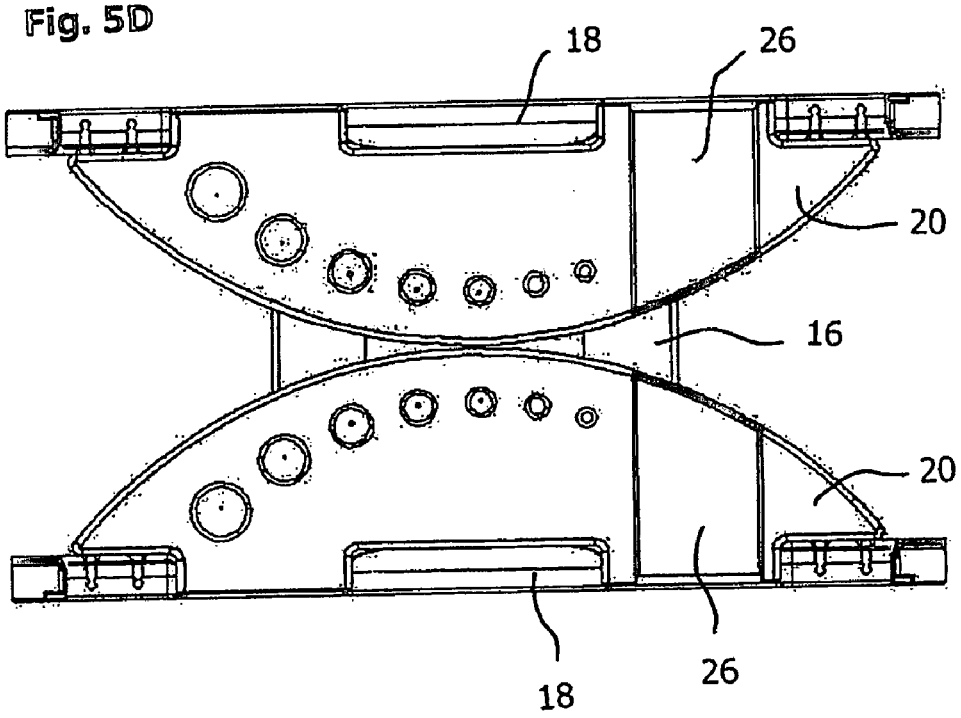
Figure 6:
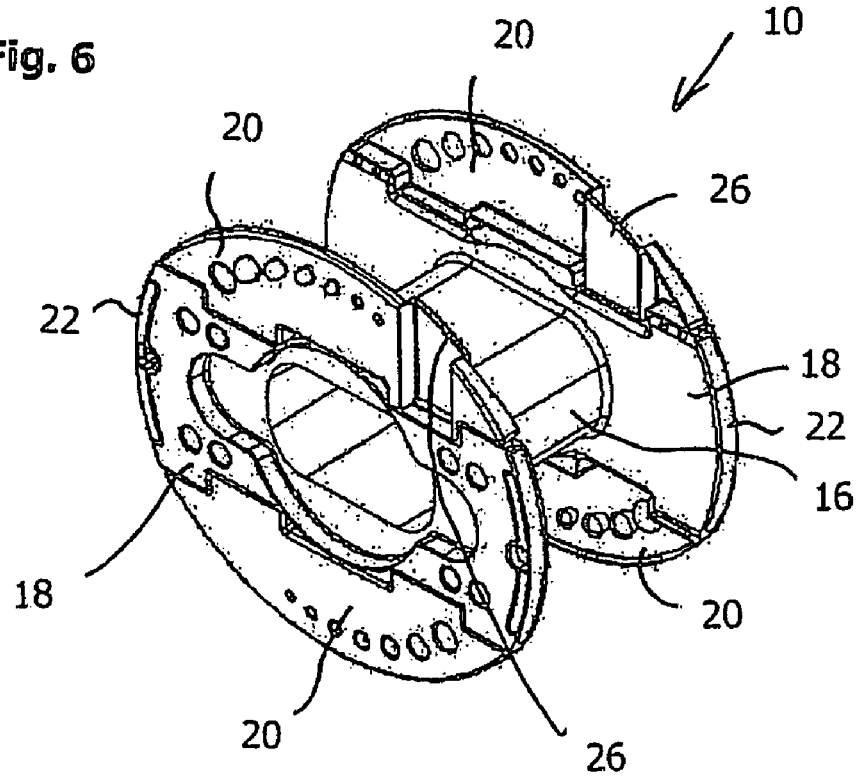
FIG. 6 is an isometric view of the reel of FIG. 5A with the flanges in the deployed state.

To allow proper stacking of the hose-reel assemblies, reels 10 must be in the correct orientation for stacking, as shown in FIGS. 2A and 3. Although abutment of adjacent reels during stacking may be sufficient to align the reels as required, the hose-reel assemblies of the present invention most preferably have an arrangement for locking the reel in the required orientation to prevent rotation relative to the support frame while the assembly is in its folded state. In the present example, this is achieved by engagement between telescopic handle 24 and the flanges. Specifically, as best seen in FIG. 5A, at least two of foldable flanges 20 are formed with a depressed slot 26 located such that, when they are folded as shown, they together define an elongated rectangular groove. The assembly is configured such that, when telescopic handle 24 is fully lowered while reel 10 is correctly orientated, the crossbar of handle 24 engages slots 26 as seen in FIG. 2A and locks reel 10 against rotation relative to support frame 12.

Figure 8:
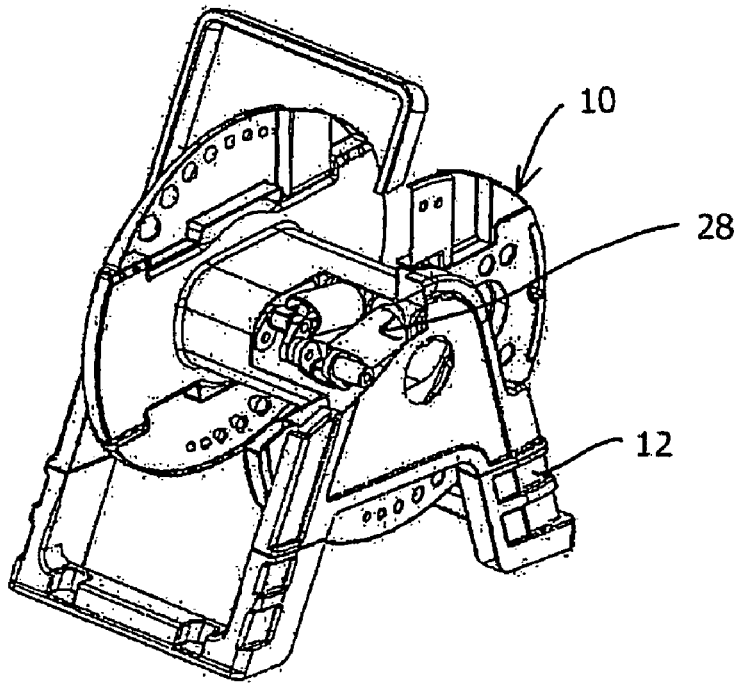
FIG. 8 is a partially cut-away isometric view of the hose-reel assembly of FIGS. 2A–7 showing a water-pressure-driven motor deployed to power rotation of the reel.

Turning now to FIG. 8, there is shown a further optional feature of the present embodiment according to which a motor 28 is provided for rotating the reel relative to the support frame. Most preferably, motor 28 is a water-pressure-actuated motor deployed primarily within drum 16 as shown here. As indicated earlier, there is particular importance to the elliptical or circular deployed flange shape of the present invention in the context of a powered hose-reel, thereby avoiding the problematic scissors-action of a rectangular flange relative to the static frame. Suitable motors are commercially available in powered hose-reel products from Hydro-Industries USA and will not be described herein in further detail. Clearly, a manual version in which a winding handle (not shown) is provided for manual winding of the reel is also within the capabilities of one ordinarily skilled in the art.

Figure 10:
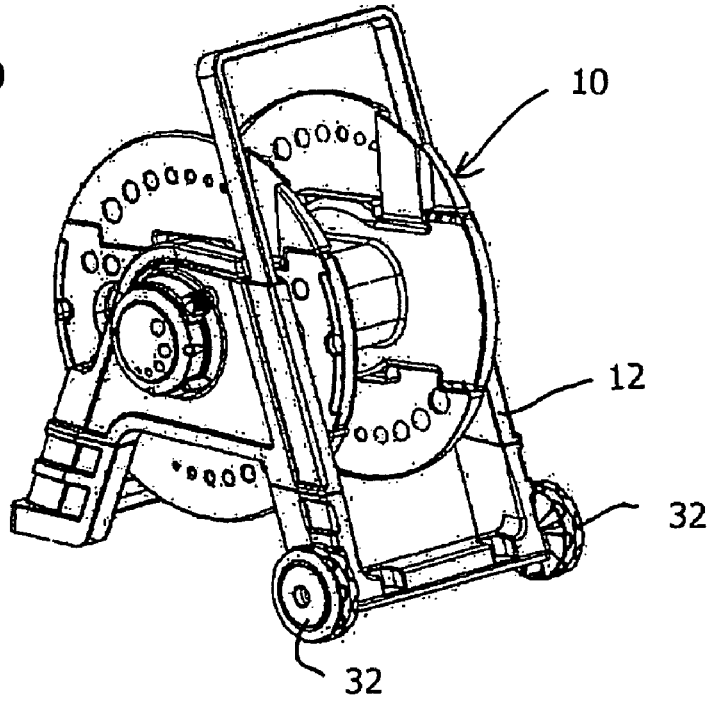
FIG. 10 is an isometric view of second variant of the hose-reel assembly of FIGS. 2A–8 with addition of wheels to form a hose cart.

In the embodiment illustrated here in FIGS. 2A–8, support frame 12 is configured for free-standing use on the ground, and preferably also has bolt holes 30 or other features to allow vertical wall mounting. FIG. 10 shows a variant implementation of this embodiment in which support frame 12 has a pair of wheels 32 supporting the stackable hose-reel assembly so as to be rollable on an underlying surface, thereby forming a hose cart. In all other respects, the implementation of FIG. 10 is analogous to the embodiment described above.

Turning now to FIGS. 11A–13, a further preferred feature of certain implementations of the present invention will now be illustrated. Specifically, according to a further preferred feature of the present invention, support frame 12 includes at least two selectively deployable legs configured to assume a non-deployed state for stacking of the hose-reel assembly and a deployed state for supporting the stackable hose-reel assembly during use. Thus, in contrast to the arrangement of FIG. 7 where hose-reel assemblies are stacked with their support frames 12 nested, the use of selectively deployable legs provides a compact total "footprint" of the hose-reel assembly in its folded and non-deployed state, allowing compact packaging and/or stacking of the assemblies without requiring nesting.

Figure 13:
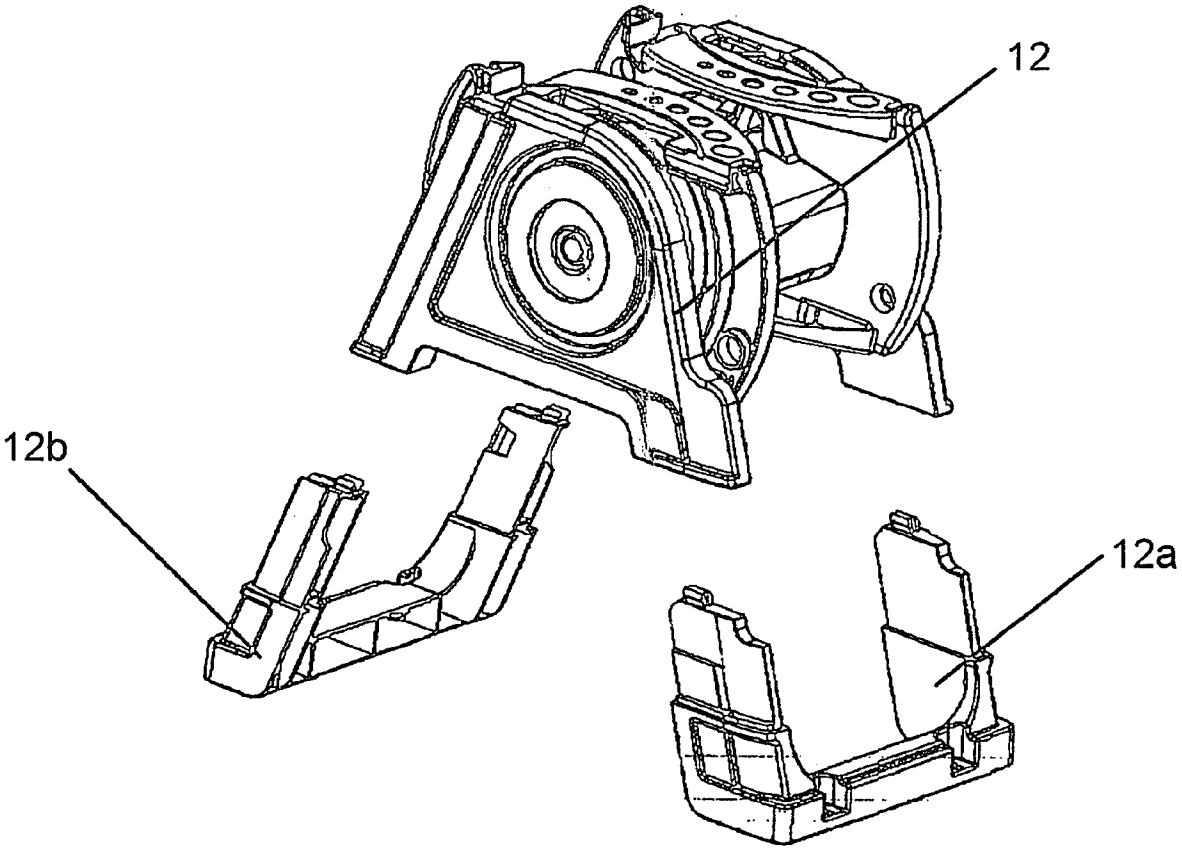
FIG. 13 is a schematic isometric view illustrating a preferred detachable-leg feature of the hose-reel assembly of FIGS. 2A–8.

By way of a first illustration, referring to FIG. 13, there is shown an implementation of the embodiment of FIGS. 2A–8, wherein the selectively deployable legs 12*a* and 12*b* are separate from a remainder of the support frame 12 when in the non-deployed state (FIG. 13) and are attachable to the remainder of the support from to provide the deployed state of FIG. 8.

Turning now to the additional embodiments of FIGS. 11A–11C and 12A–12C, these are structurally and functionally similar to the embodiment described above, equivalent elements being labeled similarly. Thus, each of the hose-reel assemblies has a reel 10 rotatably mounted on a support frame 12, the reel having a drum 16, a pair of fixed flange portions 18 and two pairs of foldable flange portions 20. These embodiments differ from the embodiment described above primarily in that the selectively deployable legs of support frame 12 are here implemented as at least two, and preferably four, collapsible legs configured to assume a collapsed state (FIGS. 11A and 12A) for stacking of the hose-reel assembly (FIGS. 11C and 12C) and a deployed state (FIGS. 11B and 12B) for supporting the stackable hose-reel assembly during use.

Figure 11A:
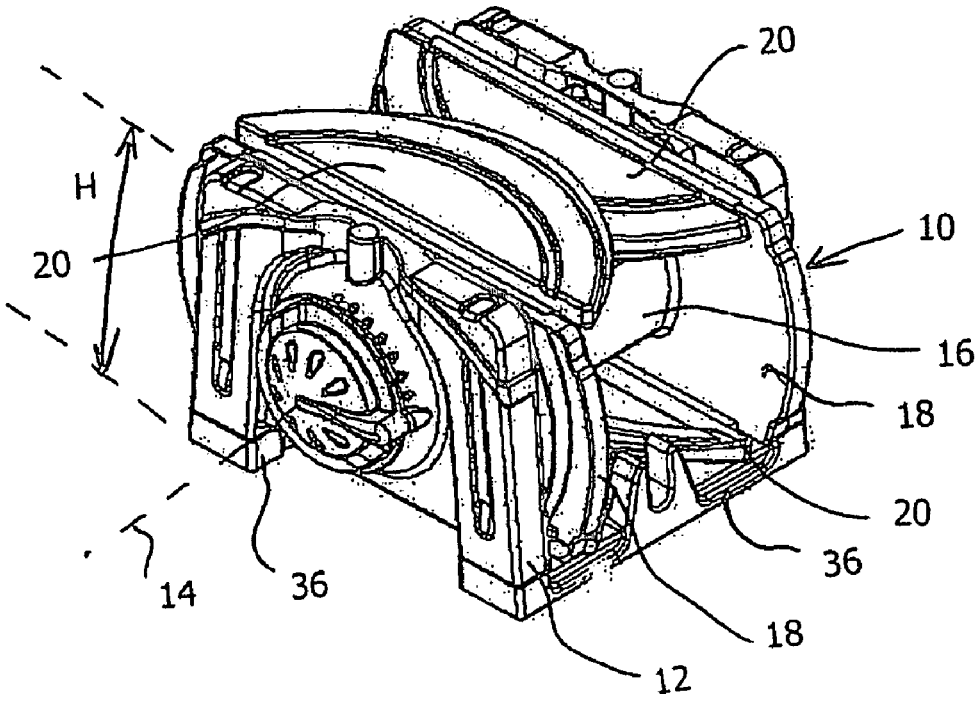
FIGS. 11A–11C are isometric views of a second preferred embodiment of a hose-reel assembly, constructed and operative according to the teachings of the present invention, shown in a folded state, in a deployed state and with two similar hose-reel assemblies stacked, respectively.
Figure 11B:
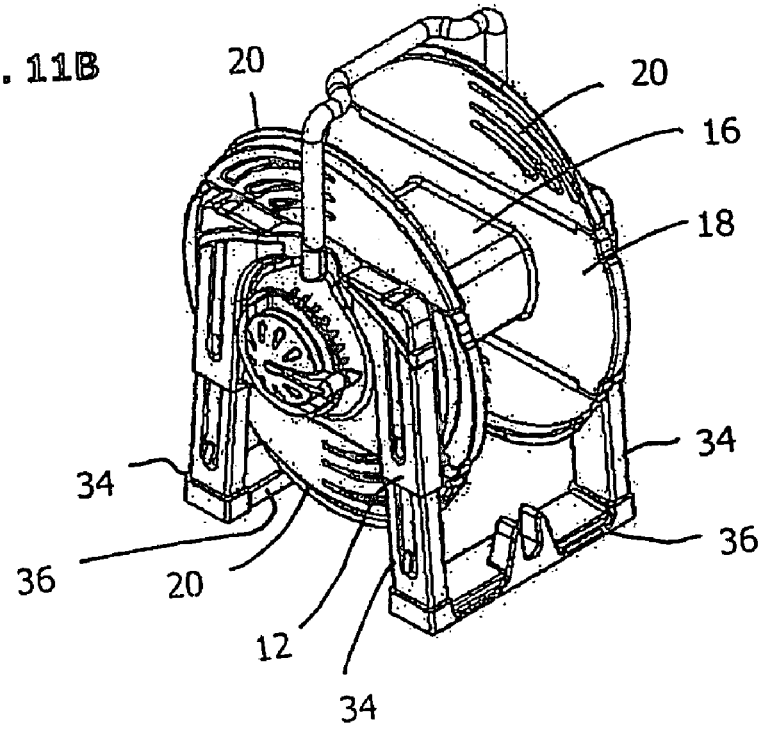
Figure 11C:
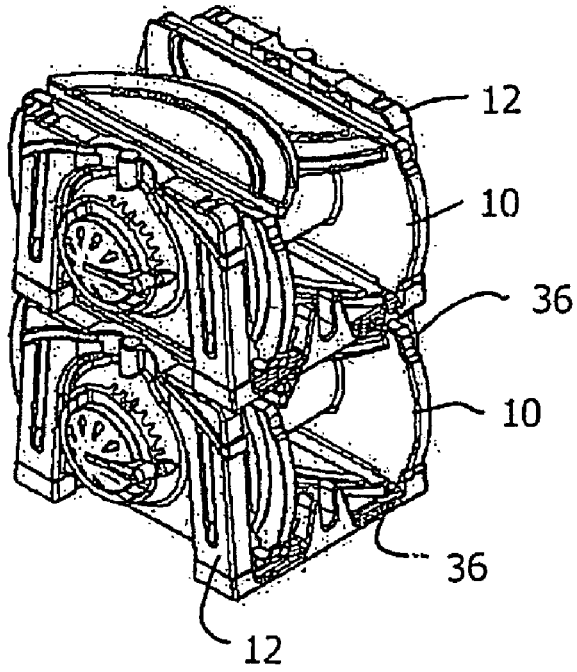

In the case of FIGS. 11A–11C, the collapsible legs are implemented as telescopic legs 34 slidable within hollow tracks between the deployed state of FIG. 11B and the collapsed state of FIG. 11A. A self-locking mechanism (not described in detail) is typically provided to hold the legs in the deployed state during use, as is known in the art. Pairs of telescopic legs 34 are connected across the width of the assembly by crossbars 36 which serve to unify the support frame structure. Additionally, in the collapsed position, crossbars 36 abut edges of fixed flange portions 18 while foldable portions 20 are in their folded state, thereby locking reel 10 to prevent rotation in the collapsed stackable state, analogous to the function of handle 24 described above with reference to FIG. 2A. The handle in this embodiment is shown as a removable handle, although a pivotally mounted or telescopic handle may also be used.

Figure 12A:
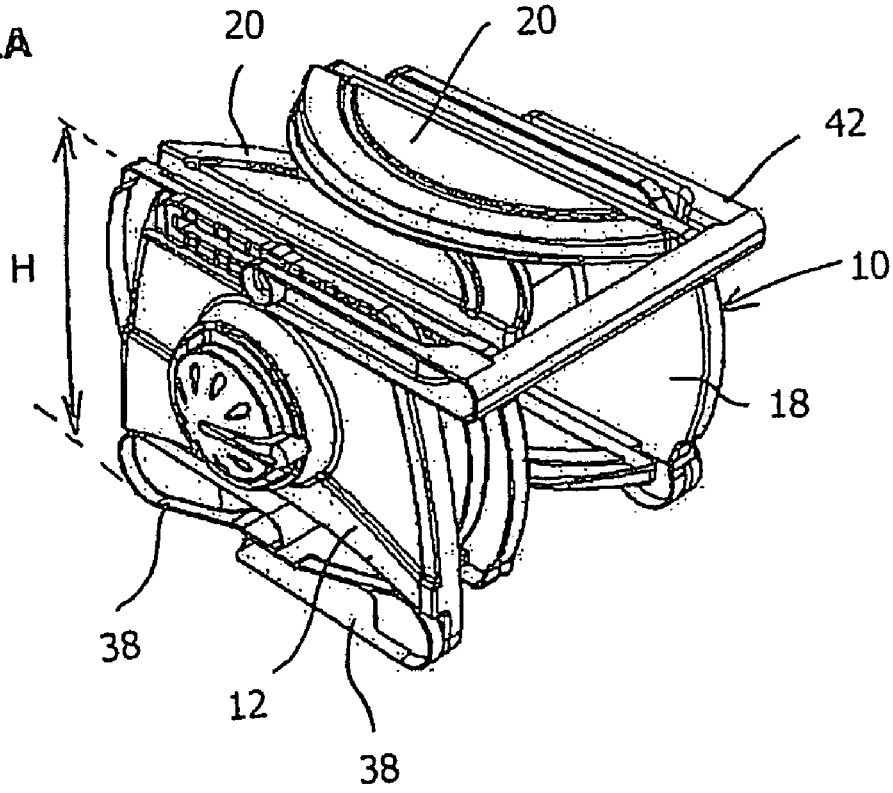
FIGS. 12A–12C are isometric views of a third preferred embodiment of a hose-reel assembly, constructed and operative according to the teachings of the present invention, shown in a folded state, in a deployed state and with two similar hose-reel assemblies stacked, respectively.
Figure 12B:
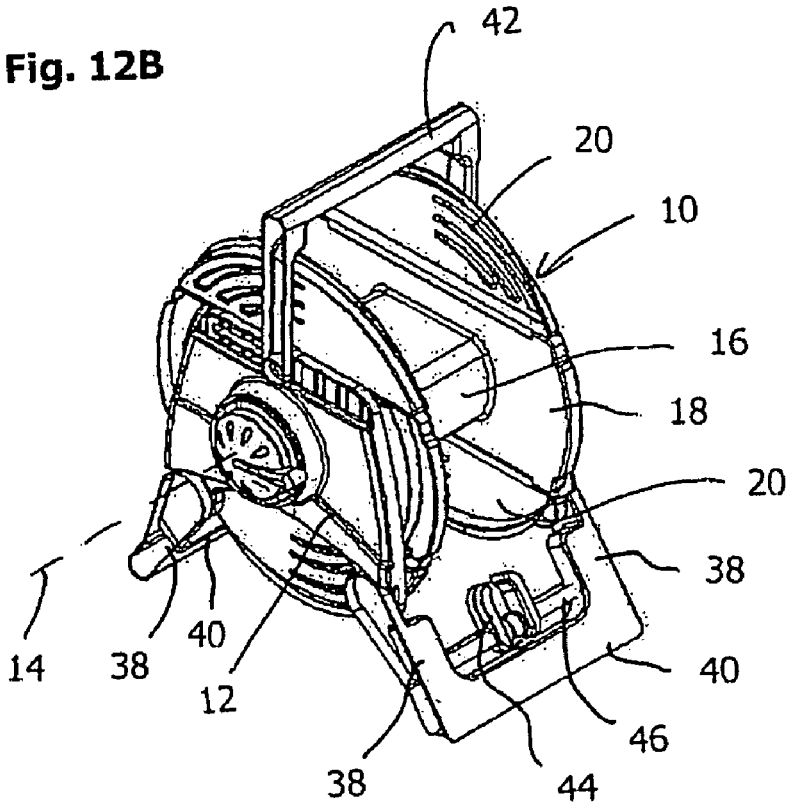
Figure 12C:
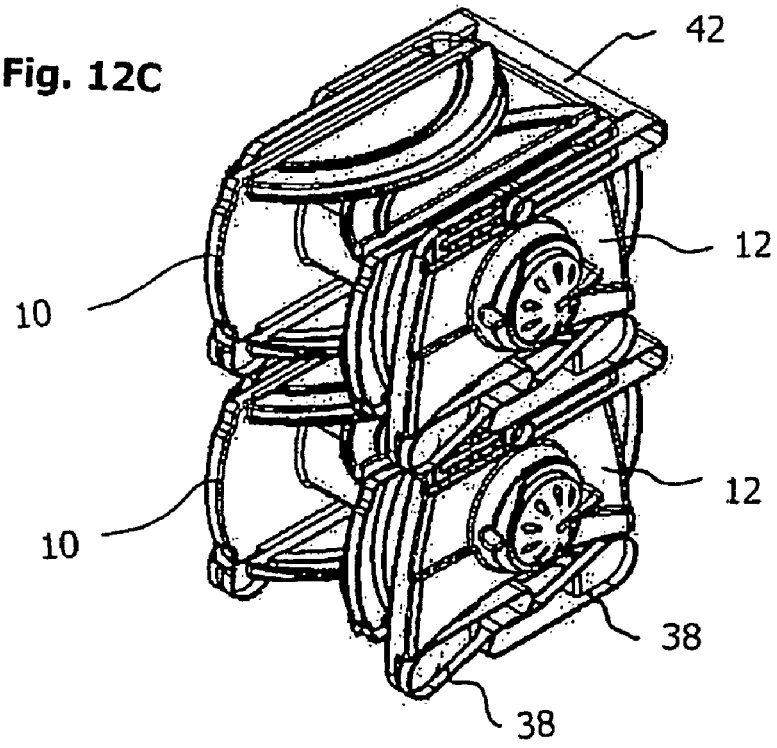

In the case of FIG. 12A-12C, the collapsible legs are implemented as foldable legs 38 pivotable between the deployed state of FIG. 12B and the collapsed state of FIG. 12A. Here too, pairs of foldable legs 38 are connected by crossbars 40. In this case, a folding handle 42 is also provided. The aforementioned rotational locking function may be performed by appropriately deployed abutment surfaces of either crossbars 40 or handle 42, or both.

Parenthetically, also shown in FIG. 12B is a hose guide feature which is an optional and preferred feature for all embodiments of the present invention. The hose guide includes a guide clip 44 which is slidable along a rod 46 parallel to axis 14. By passing the hose (not shown) through guide clip 44, angle at which the hose reaches the reel is limited to a relatively small range of angles, thereby providing more reliable winding.

It will be noted that the embodiments of FIGS. 11A–11C and FIGS. 12A–12C assume a collapsed shape of almost rectangular form (FIGS. 11A and 12A). In other words, in contrast to the first embodiment where the legs of the support frame extend beyond the stacking step height H and the frames nest, the support frame of these embodiments is configured such that the vertical dimension of the entire assembly including the frame lies within stacking step height H. The dimension of the collapsed legs typically adds to the stacking height H, making it somewhat bigger than the fixed flange portion breadth B, but nevertheless achieving significant volume reduction compared to a non-folding flange and offering various additional advantages. Specifically, the collapsible-leg embodiments lend themselves well to packaging in boxes, where each hose-reel assembly is individually packed in a rectangular box of height H, i.e., where a first dimension of the box (referred to as the "width") is sized to receive the width of the hose-reel assembly as measured parallel to axis 14, and at least one dimension of the box perpendicular to the width (referred to as the "height") is less than the dimension D of the deployed reel diameter. These boxes may then be stacked on each other with a stacking step height H. Since the volume saving of these structures does not depend upon nesting of the frames, they also provide a reduced volume for shipping and storage of even a single item, thereby reducing costs for individual delivery (e.g. for mail-order or internet sales) and for transport and handling by the consumer.

Similarly, in the case of detachable legs as illustrated in FIG. 13, the legs may readily be accommodated within empty regions of the folded reel such that the entire assembly is received within a rectangular box of dimensions as described in the previous paragraph with minimal height added to accommodate the legs.

It will be appreciated that the above descriptions are intended only to serve as examples, and that many other embodiments are possible within the scope of the present invention as defined in the appended claims.

What is claimed is:

1. A stackable hose-reel assembly comprising:

(a) a support frame; and (b) a reel rotatably attached to said frame so as to be rotatable about an axis of rotation, said reel including:

(i) a drum circumscribing said axis of rotation for receiving a length of hose coiled thereabout; and (ii) a pair of flanges, one of said flanges being attached to, or integrally formed with, each of a first side and a second side of said drum, each of said flanges having a fixed portion rigidly associated with said drum and at least one foldable portion hinged to said fixed portion so as to be displaceable between a folded state and a deployed state, such that, when said foldable portions assume said folded state, the hose-reel assembly is stackable with other similar hose-reel assemblies at a stacking step height H, and when said foldable portions assume said deployed state, said fixed portion and the corresponding at least one foldable portion together form a flange with a minimum dimension D measured perpendicular to said axis, where D is greater than H.

2. The stackable hose-reel assembly of claim 1, wherein D is greater than H by at least 50%.

3. The stackable hose-reel assembly of claim 1, wherein each of said flanges has two of said foldable portions hinged to said fixed portion along substantially parallel hinges on opposite sides of said axis.

4. The stackable hose-reel assembly of claim 1, wherein each of said flanges has a substantially elliptical outer shape when said foldable portions are in said deployed state.

5. The stackable hose-reel assembly of claim 1, wherein each of said flanges has a substantially circular outer shape when said foldable portions are in said deployed state.

6. The stackable hose-reel assembly of claim 1, wherein each of said flanges further includes at least two retractable extension portions radially displaceable between a recessed position in which said extension portions are retracted within said flanges and an extended position in which said extension portions provide a locally increased maximum dimension of the flange as measured perpendicular to said axis.

7. The stackable hose-reel assembly of claim 1, wherein said fixed portions and said foldable portions are configured such that, when said foldable portions are moved from said folded state to said deployed state, said foldable portions are locked, at least temporarily, in said deployed state.

8. The stackable hose-reel assembly of claim 1, further comprising a telescopic handle associated with said support frame and configured to assume a collapsed state for stacking of the hose-reel assembly and an extended state for holding the stackable hose-reel assembly during use.

9. The stackable hose-reel assembly of claim 8, wherein said flanges and said telescopic handle are configured such that, when said telescopic handle assumes said collapsed state and said foldable portions assume said folded state, said telescopic handle and said reel engage so as to substantially lock said reel against rotation relative to said support frame.

10. The stackable hose-reel assembly of claim 1, wherein said support frame includes at least two selectively deployable legs configured to assume a non-deployed state for stacking of the hose-reel assembly and a deployed state for supporting the stackable hose-reel assembly during use.

11. The stackable hose-reel assembly of claim 10, wherein said selectively deployable legs are separate from a remainder of said support frame when in said non-deployed state and are attachable to said remainder of the support from to provide said deployed state.

12. The stackable hose-reel assembly of claim 10, wherein said selectively deployable legs are implemented as foldable legs pivotable between said non-deployed state and said deployed state.

13. The stackable hose-reel assembly of claim 10, wherein said selectively deployable legs are implemented as telescopic legs slidable between said non-deployed state and said deployed state.

14. The stackable hose-reel assembly of claim 10, wherein said support frame is configured such that, when said selectively deployable legs are in said non-deployed state, one dimension of the stackable hose-reel assembly measured perpendicular to said axis is no greater than stacking step height H.

15. The stackable hose-reel assembly of claim 10, wherein said flanges and said selectively deployable legs are configured such that, when said selectively deployable legs assume said non-deployed state and said foldable portions assume said folded state, said reel and a surface associated with at least one of said selectively deployable legs engage so as to substantially lock said reel against rotation relative to said support frame.

16. The stackable hose-reel assembly of claim 1, wherein said support frame has a minimum dimension measured perpendicular to said axis greater than stacking step height H, said support frame being stackable with other similar support frames at stacking step height H.

17. The stackable hose-reel assembly of claim 1, further comprising a motor associated with said support frame and said reel for rotating said reel relative to said support frame.

18. The stackable hose-reel assembly of claim 17, wherein said motor is deployed primarily within said drum.

19. The stackable hose-reel assembly of claim 1, further comprising at least one wheel associated with said support frame for supporting the stackable hose-reel assembly so as to be rollable on an underlying surface.

* * * * *